United States Patent [19]

Lewis, Jr. et al.

[11] 4,149,634

[45] Apr. 17, 1979

[54] LIMITED DIMENSION BICYCLE SHIPPING PACKAGE

[75] Inventors: Edward C. Lewis, Jr., Miamisburg, Ohio; Cleon L. Whiteley, Richmond, Ind.

[73] Assignee: Huffy Corporation, Miamisburg, Ohio

[21] Appl. No.: 912,351

[22] Filed: Jun. 5, 1978

Related U.S. Application Data

[63] Continuation of Ser. No. 792,187, Apr. 29, 1977, abandoned.

[51] Int. Cl.[2] ..... B65D 85/68

[52] U.S. Cl. ..... 206/335; 217/37

[58] Field of Search ..... 206/335, 319; 217/37, 217/38

[56] References Cited

U.S. PATENT DOCUMENTS

| | | | |
|---|---|---|---|
| 478,954 | 7/1892 | Davis | 206/335 |
| 2,339,947 | 1/1944 | Reaume | 206/335 |
| 3,871,546 | 3/1975 | Thompson | 206/335 |
| 3,929,225 | 12/1975 | Locke et al. | 206/335 |

*Primary Examiner*—William Price
*Assistant Examiner*—Joseph M. Moy
*Attorney, Agent, or Firm*—Biebel, French & Nauman

[57] ABSTRACT

A bicycle shipping package in which a bicycle is positioned in a carton with the bicycle front wheel removed, the rear wheel mounted and the bicycle components positioned in the carton such that the package dimensions of length plus girth are less than the maximum accepted for shipment via less expensive modes of transportation, such as by parcel delivery services.

1 Claim, 5 Drawing Figures

LIMITED DIMENSION BICYCLE SHIPPING PACKAGE

This is a continuation of application Ser. No. 792,187, filed Apr. 29, 1977, now abandoned.

BACKGROUND OF THE INVENTION

One of the more popular size bicycles marketed is a bicycle with a twenty inch wheel. These bicycles are generally shipped with the front and rear wheels mounted in the front and rear wheel forks, but with the seat removed from the seat post and the handle bars and handle bar stem removed from the bicycle and included in the carton in which the bicycle is shipped. The attachment of the bicycle seat to the seat post and the handle bars and handle bar stem to the bicycle are relatively easily accomplished and there is, therefore, relatively little or no resistance from customers to packaging bicycles with these and other minor components disassembled.

However the resulting packages, while more compact than if these components were assembled, are still too large to be shipped by the most economical shipping carriers. For example, conventional bicycle packages cannot be shipped by parcel delivery service because the length plus the girth limitations imposed by a commonly used parcel service is 108 inches, and a typical twenty inch bicycle packaged conventionally with just the handle bars and seat removed would generally run well in excess of this and may in fact, depending upon the particular model of twenty inch bicycle packaged, run in excess of 130 inches.

As used herein the term "length plus girth" is the dimension arrived at by measuring the outside length of the carton plus the width of its top and bottom walls plus the height of each of its side walls. Because conventionally packaged twenty inch bicycles cannot meet the 108 inches length plus girth limitation, they must be shipped by other methods, such as motor or rail carrier, at extremely higher shipping costs.

In an attempt to reduce the overall size of a bicycle shipping package, although not necessarily to permit such packages to be shipped by parcel service rather than, for example, motor or rail carrier, one approach has been to remove the front wheel of the bicycle from its forks. The removal and replacement of the bicycle front wheel is a relatively simple job and can be performed with a minimum of tools and, therefore, similarly to the removal of the handle bars and seat, does not meet with significant customer resistance. Rear wheel removal, however, is generally not considered feasible because the drive chain must also be removed and, particularly in the case of multi-speed bicycles, it is more difficult and time consuming to reassemble a bicycle on which the rear wheel has been removed as opposed to the front wheel.

Two U.S. patents which disclose a bicycle package in which the front wheel is removed are U.S. Pat. Nos. 2,339,947 and 3,929,225. In the former the front wheel is simply removed and placed alongside the remainder of the bicycle and maintained in position by means of a spacer. In U.S. Pat. No. 3,929,225, an end opening carton is disclosed having upper and lower trays which are provided with cut outs to receive the front wheel and the remainder of the bicycle components. The assembly of front wheel, bicycle, bicycle components and upper and lower trays are slid into position through one end of the carton.

However, insofar as is known, neither of the packages described in the above noted patents has, for a twenty inch bicycle, a length plus girth dimension of 108 inches or less, and hence, such packages cannot be shipped by relatively inexpensive parcel service.

SUMMARY OF THE INVENTION

The present invention provides a limited dimension bicycle package for twenty inch bicycles or smaller which has a length plus girth dimension that does not exceed 108 inches and is, therefore, shippable by means of parcel service rather than, for example, by motor or rail carrier.

As a result significant savings can be obtained in shipping. For example, shipping costs can be reduced to less than 14% of the comparable costs of shipping by, for example, motor carrier. Stated another way, shipping costs are reduced in this same example by approximately 86%.

The limited dimension package of the present invention is attained by a combination of overall package design and the positioning of the bicycle and its components in specific relationships with respect to each other and the interior of the carton.

For example, the front wheel of the bicycle is not only removed but is elevated with respect to the bottom wall of the carton, allowing the front wheel to be shifted rearwardly, thereby shortening the length of the carton. Additionally, the front wheel fork in most models is turned 90° to the left, thereby further shortening the length of the carton, but not at the sacrifice of additional width, since the bicycle is positioned somewhat diagonally in the carton and the extra clearance at the front of the carton not only accommodates the rotated front wheel fork but the front wheel, which is positioned between the left hand side of the bicycle frame adjacent its front end and the left hand wall of the carton.

In most models, the front wheel will be supported by the bicycle crank housing and the front wall of the carton so that the front wheel is positioned in the carton in spaced relationship to the bottom wall. To further accommodate the positioning of the bicycle within the carton the left hand crank arm is projected forwardly of the bicycle and the carton and, where the dimensions of the bicycle front tire permit, the left hand crank arm can lie outside the bicycle front wheel.

Where the width of the front tire is such that it cannot be received between the left hand crank arm and the bicycle frame, a pad may be provided in the bottom of the carton to elevate the front wheel with respect to the carton bottom wall and permit the front wheel to be shifted rearwardly to reduce the overall length of the package.

Additionally, since the height of the carton need only be great enough to accommodate the elevated front wheel and the mounted rear wheel, the seat post is preferably removed from the bicycle and packaged with other components within the carton. Since the assembly of the seat post is a relatively simple task, its removal does not meet with resistance even though it is customary for such seat posts to be shipped assembled.

It should also be noted that the package of the present invention has its side and end walls formed as a continuous tube and its top and bottom walls formed as overlapped flaps. This facilitates assembly of the package since it permits the open ended tube to travel through the assembly line and the various bicycle components inserted into the tube from both open ends, as opposed to restricting packaging to an end of the carton as in the case of using top and bottom positioning trays, or through the top only of the carton.

These and other advantages of the present invention will be apparent from the following detailed description.

DESCRIPTION OF THE PREFERRED EMBODIMENT

Figure 1:
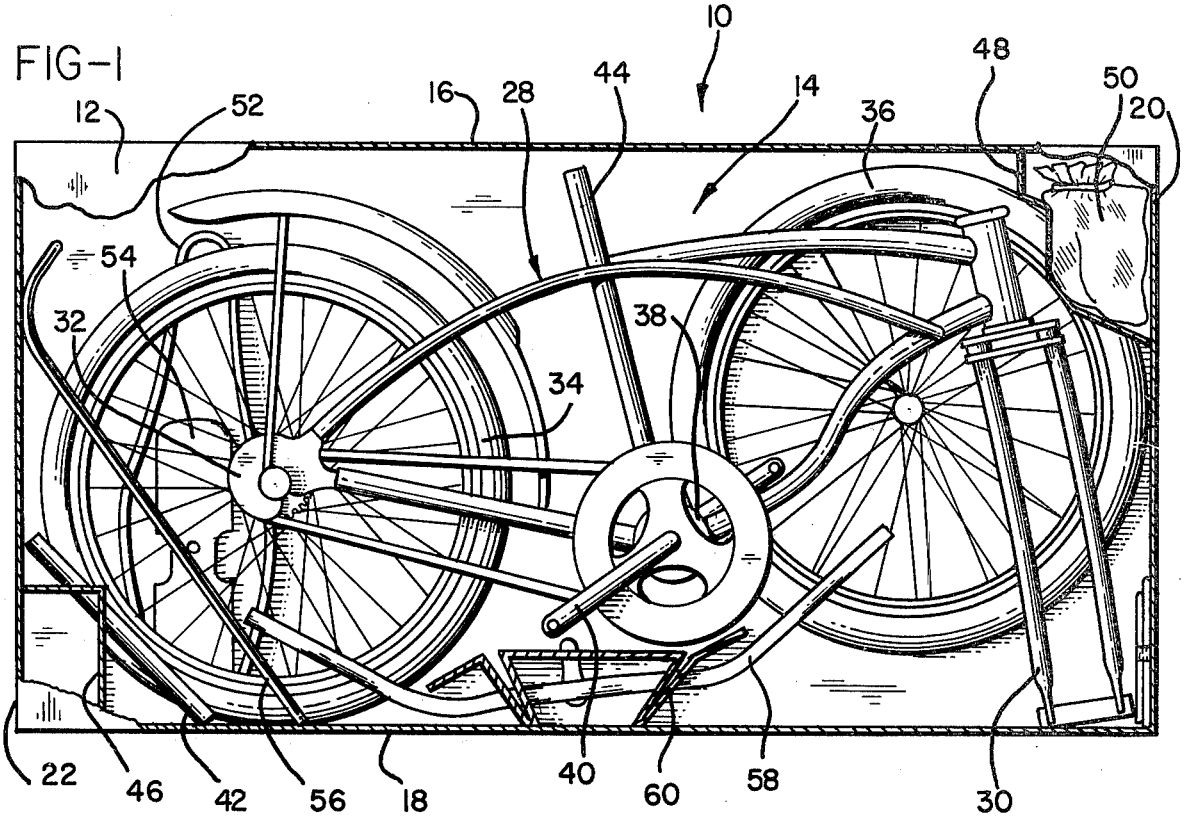
FIG. 1 is an elevated view of the package of the present invention with the right hand side wall removed.

As seen in FIG. 1 of the drawings, a package 10 in accordance with the present invention includes a carton 12 and a bicycle 14, with some of the components of the latter disassembled. The carton 12, as seen in FIGS. 1 through 3 of the drawings, includes top and bottom walls 16 and 18, front and back walls 20 and 22 and left and right side walls 24 and 26.

The bicycle includes a frame 28 having front and rear forks 30 and 32, with a rear wheel 34 mounted in the rear wheel forks. The front wheel fork is turned approximately 90° from the axis of rotation of the rear wheel 34 which provides an appreciable shortening of the overall length of the carton.

Figure 2:
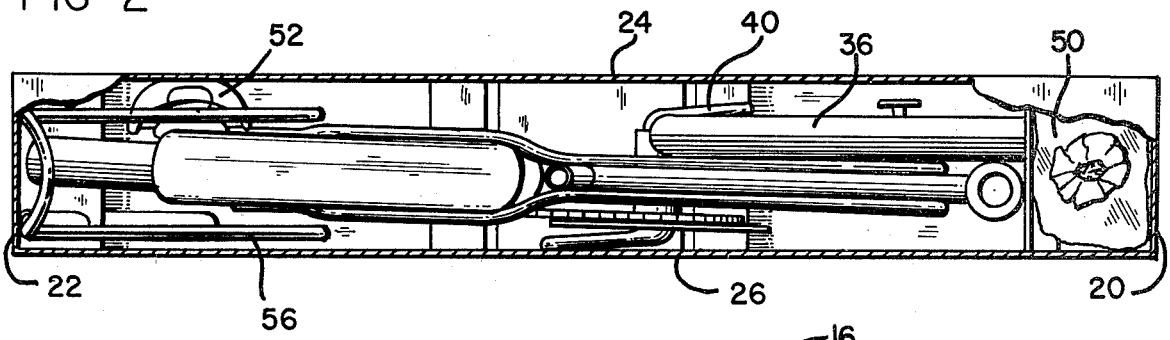
FIG. 2 is a top plan view of the package of the present invention with the top wall removed.
Figure 3:
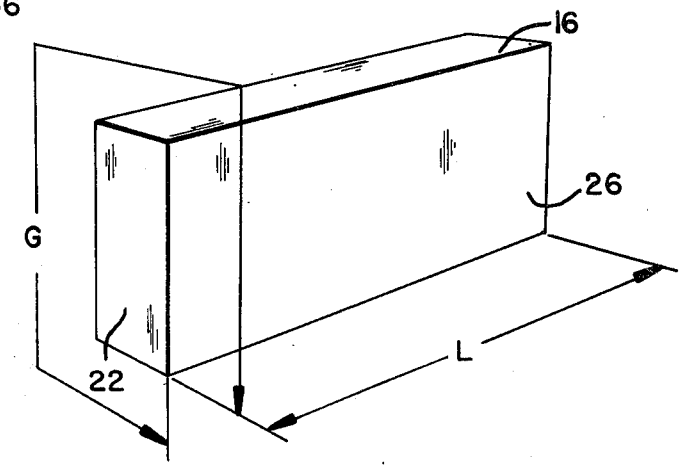
FIG. 3 is a perspective view illustrating the critical dimensions of the package.

As best seen in FIG. 2 of the drawings, the bicycle is disposed within the carton somewhat angularly with respect to the length of the carton, providing room for a front wheel 36 to be disposed along the left hand side of the bicycle frame and resting, as best seen in FIG. 1, on a crank housing 38 of the bicycle and the front wall 20 of the carton.

This has the effect of raising the front wheel 36 above the bottom wall 18 of the carton as the bicycle front wheel is shifted rearwardly and decreases the overall length of the carton. Generally the width of the front wheel of the bicycle will permit it to be positioned between the bicycle frame and a left hand, forwardly projecting crank arm 40 of the bicycle. It will also be noted that a seat post 42 for the bicycle is removed from the seat mast 44 and received in holes formed in the rear wheel pad 46, thus reducing the overall height of the bicycle.

Various bicycle accessories are packaged in a bag and received within a front wheel pad 48, as seen at 50, while the bicycle seat 52 and front fender 54 are positioned between the left hand side of the bicycle and the left hand side of the carton adjacent the rear wheel 34. The saddle leg 56 lays over the rear wheel 34 and is prevented from sliding forward by the saddle 57 and the handle bars 58 are received in a pad 60 and positioned in the bottom of the package.

As a result of positioning the bicycle and its components in the carton with the left hand crank arm 40 projecting forwardly and the front wheel nested with the left hand crank arm in spaced relationship to the carton bottom wall, the length plus girth of the carton for bicycles having wheels of approximately twenty inches in diameter or less is less than 108 inches. As seen in FIG. 3 of the drawings, the length of the carton is indicated by the letter L while the girth is the total of the height of both side walls and the width of the top and bottom walls. As noted previously, by limiting the length plus girth of the carton the resulting package can be shipped by parcel delivery service at only a small fraction of the cost of shipping by, for example, motor carriers.

Figure 5:
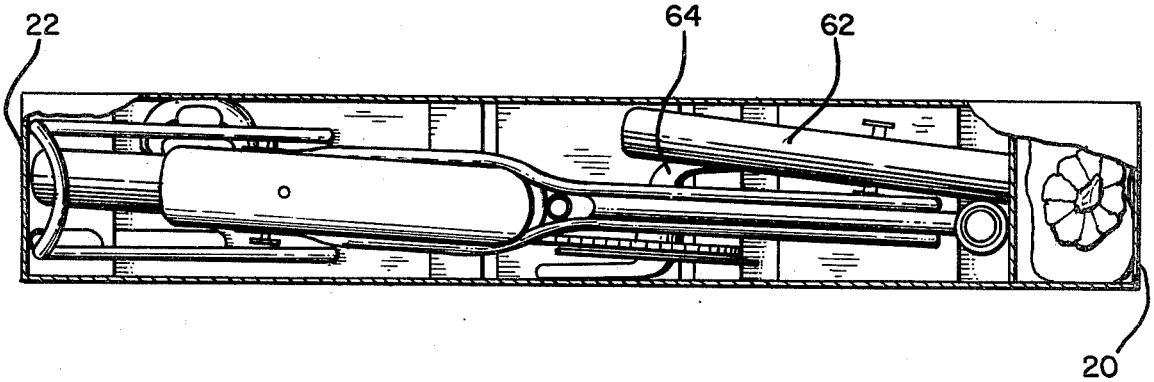
FIG. 5 is a view similar to FIG. 2, but illustrating the embodiment of FIG. 4.

While the majority of bicycles packaged in accordance with the present invention will have wheels narrow enough to be positioned between the left hand crank arm and the bicycle frame as seen in FIG. 2 of the drawings, certain models may have significantly wider tires so that, as seen in FIG. 5 of the drawings, the front wheel 62 is nested with the left hand crank arm 64, not in the manner shown in FIG. 2, but as shown in FIG. 5 of the drawings.

Figure 4:
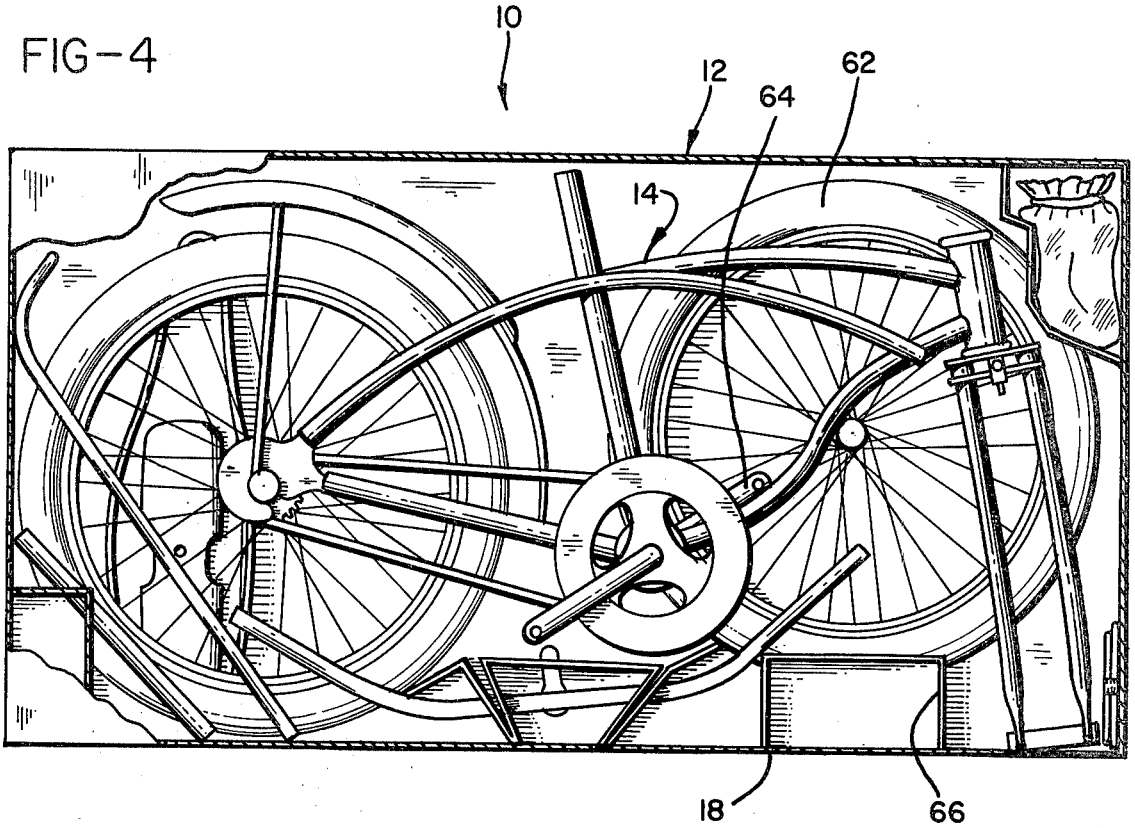
FIG. 4 is a view similar to FIG. 1, but illustrating a modified form of the invention.

As a result the front wheel 62 cannot rest on the crank housing as shown in FIG. 1 of the drawings, but must be provided with a pad, as indicated at 66 in FIG. 4 of the drawings, to raise the front wheel above the bottom wall 18 of the carton and allow the wheel to be shifted rearwardly to decrease the length of the carton 12.

Regardless of the width of the bicycle front wheel, it will be seen that the present invention provides a bicycle package in which the bicycle components are positioned within the carton such that the length plus girth of the resulting package is within acceptable limits for parcel delivery service, resulting in significant shipping savings.

While the articles herein described constitute preferred embodiments of the invention, it is to be understood that the invention is not limited to these precise articles, and that changes may be made therein without departing from the scope of the invention.

What is claimed is:

1. In a bicycle shipping package comprising a carton having opposed right and left hand side walls, top and bottom walls and front and rear walls and a bicycle received in said carton and having front and rear wheels, a front wheel fork including downwardly and outwardly projecting legs, a rear wheel fork, said front wheel being removed from said front fork and said rear wheel being mounted in said rear fork, a crank assembly including a crank housing, a sprocket on the right hand side of said housing and oppositely projecting left and right hand crank arms, and a bicycle seat post for attaching a seat to said bicycle, the improvement comprising:

said left hand crank arm projecting forwardly of said bicycle and said carton, said front wheel being nested with said forwardly projecting left hand crank arm with said front wheel engaging said crank housing and said front wall and positioned between said left hand carton wall and the left hand front of said bicycle, said front wheel being positioned in spaced relationship to said carton bottom wall, the height of said side and end walls being greater than 20 inches, and said bicycle seat post is removed from said bicycle, said front and back walls and said side walls are formed as a continuous tube, said top and bottom walls are formed from overlapped flaps, the total length plus girth of said carton being less than 108 inches.

* * * * *